US007699095B2

(12) United States Patent
Beamer et al.

(10) Patent No.: US 7,699,095 B2
(45) Date of Patent: Apr. 20, 2010

(54) BENDABLE CORE UNIT

(75) Inventors: Henry Earl Beamer, Middleport, NY (US); Steve C. Brick, Lockport, NY (US); Christopher Alfred Fuller, Buffalo, NY (US); Robert Michael Runk, N. Tonawanda, NY (US)

(73) Assignee: Delphi Technologies, Inc., Troy, MI (US)

( * ) Notice: Subject to any disclaimer, the term of this patent is extended or adjusted under 35 U.S.C. 154(b) by 1057 days.

(21) Appl. No.: 11/392,212

(22) Filed: Mar. 29, 2006

(65) Prior Publication Data

US 2007/0227695 A1 Oct. 4, 2007

(51) Int. Cl.
*F28D 1/04* (2006.01)
*F28F 7/00* (2006.01)

(52) U.S. Cl. ..... 165/151; 165/172

(58) Field of Classification Search ..... 165/151, 165/153, 172, 175, 176, 140, 76
See application file for complete search history.

(56) References Cited

U.S. PATENT DOCUMENTS

| | | | | |
|---|---|---|---|---|
| 3,545,224 | A | 12/1970 | Nicoski | |
| 4,719,967 | A | 1/1988 | Scarselletta | |
| 4,876,778 | A | 10/1989 | Hagihara et al. | |
| 5,174,366 | A | 12/1992 | Nagakura et al. | |
| 5,267,610 | A | 12/1993 | Culbert | |
| 5,279,360 | A | 1/1994 | Hughes et al. | |
| 5,575,326 | A | 11/1996 | Asami et al. | |
| 5,826,649 | A * | 10/1998 | Chapp et al. | 165/174 |
| 6,289,978 | B1 | 9/2001 | Antoine | |
| 6,408,939 | B1 * | 6/2002 | Sugimoto et al. | 165/140 |
| 6,439,300 | B1 | 8/2002 | Falta et al. | |
| 6,615,488 | B2 | 9/2003 | Anders et al. | |
| 6,672,375 | B1 | 1/2004 | Shippy et al. | |
| 6,821,638 | B2 | 11/2004 | Obeshaw | |
| 6,880,620 | B2 | 4/2005 | Huang | |
| 2005/0089707 | A1 | 4/2005 | Obeshaw | |

FOREIGN PATENT DOCUMENTS

| | | |
|---|---|---|
| JP | 01-155196 | 6/1989 |
| JP | 02-050088 | 2/1990 |

(Continued)

OTHER PUBLICATIONS

English language Abstract for JP 01-155196 extracted from *Searching PAJ* database dated Feb. 1, 2006.

(Continued)

*Primary Examiner*—Tho v Duong
(74) *Attorney, Agent, or Firm*—Patrick M. Griffin

(57) ABSTRACT

A core unit for a heat exchanger comprises a pair of headers spaced from one another each defining a fluid space for receiving a fluid therein and each defining a plurality of apertures. A first region comprising a plurality of first tubes extends between the headers and a first fin is disposed between adjacent pairs of the first tubes. A second region comprising a plurality of second tubes extends between the headers and a second fin is disposed between adjacent pairs of the second tubes. A crushable center different than the first and second regions is disposed parallelly between the first and second regions for controllably crushing when the headers are bent.

1 Claim, 6 Drawing Sheets

FOREIGN PATENT DOCUMENTS

| | | | | |
|---|---|---|---|---|
| JP | 02-205251 | | | 8/1990 |
| JP | 02-298796 | | | 12/1990 |
| JP | 03-005694 | | | 1/1991 |
| JP | 03-079994 | | | 4/1991 |
| JP | 03-174971 | | | 7/1991 |
| JP | 04-136690 | | | 5/1992 |
| JP | 04344033 | A | * | 11/1992 |
| JP | 05-060481 | | | 3/1993 |
| JP | 07012481 | A | * | 1/1995 |
| JP | 10-202334 | | | 4/1998 |
| JP | 2000154992 | A | * | 6/2000 |
| JP | 2002243381 | A | * | 8/2002 |
| JP | 2005090806 | A | * | 4/2005 |
| JP | 2005133966 | A | * | 5/2005 |
| WO | WO 01/35042 | | | 5/2001 |

OTHER PUBLICATIONS

English language Abstract for JP 02-050088 extracted from *Searching PAJ* database dated Feb. 1, 2006.

English language Abstract for JP 02-205251 extracted from *Searching PAJ* database dated Feb. 1, 2006.

English language Abstract for JP 02-298796 extracted from *Searching PAJ* database dated Feb. 1, 2006.

English language Abstract for JP 03-005694 extracted from *Searching PAJ* database dated Feb. 1, 2006.

English language Abstract for JP 03-079994 extracted from *Searching PAJ* database dated Feb. 1, 2006.

English language Abstract for JP 03-174971 extracted from *Searching PAJ* database dated Feb. 1, 2006.

English language Abstract for JP 04-136690 extracted from *Searching PAJ* database dated Feb. 1, 2006.

English language Abstract for JP 05-060481 extracted from *Searching PAJ* database dated Feb. 1, 2006.

English language Abstract for JP 10-202334 extracted from *Searching PAJ* database dated Feb. 1, 2006.

* cited by examiner

BENDABLE CORE UNIT

BACKGROUND OF THE INVENTION

1. Field of the Invention

The subject invention relates to a core unit for a heat exchanger, and more specifically to a core unit bent relative to an axis perpendicular to a pair of headers such that the headers are bent.

2. Description of the Related Art

Various core units, shown generally at 10 in FIGS. 1 and 2, are known that include bends for fitting into smaller, more compact heating, ventilation, and air conditioning (HVAC) system cabinets. Core units 10 generally comprise a pair of headers 12 spaced from one another for receiving a fluid therein and having a plurality of apertures 14 for connecting a plurality of tubes 16. The tubes 16 are in fluid communication with the apertures 14 for transferring fluid between the headers 12. Fins 18 are disposed between adjacent pairs of tubes 16 for dissipating heat from the fluid in the tubes 16. The fins 18 are generally formed from sheet metal and are formed into a shape of an accordion. The fins 18 may be referred to as corrugated fins or air centers. The fins 18 may also be louvered, i.e., the fins 18 have louvers defined therein to increase heat transfer as is understood by those of ordinary skill in the art.

The core units 10 can be orientated in the HVAC system in various positions. In one orientation of the core unit, the tubes 16 are horizontal and the fins 18 are generally vertically aligned and transverse relative to the tubes 16. Because the convolutions of the fins 18 are up and down and the tubes 16 are horizontal, condensate may collect in the convolutions resulting in inadequate drainage. The condensate accumulation increases the air pressure drop and decreases performance of the core unit. The blockage can also result in ice formation during heat pump heating modes.

Further, it is known to bend the core units 10 so that the core units 10 fit within the cabinet. Generally, the core units 10 are bent about an axis that is parallel to the headers 12 such that the headers 12 are not bent. Bending the core unit in this manner slightly elongates the tubes 16 and only a minimal amount of fins 18 become crushed. The overall performance of the core unit is maintained with such an orientation. Also, the condensate accumulation is still likely to occur when the core unit is positioned having the tubes 16 horizontal.

One solution to overcoming the inadequate drainage is to orientate the core unit such that the tubes 16 are vertical and the fins 18 are generally horizontal and transverse to the tubes 16. The condensate is less likely to collect between the convolutions of the fins 18 when the tubes 16 are vertically aligned.

Prior attempts have been made to bend the core unit about an axis perpendicular to the headers 12 when the tubes 16 are vertical. However, when the core unit is bent, the tubes 16 and fins 18 next adjacent the bend undergo reduced performance. When the header is bent, as shown in FIG. 1, on the inner radius of the bend, the fin between adjacent tubes 16 is crushed thereby reducing and/or preventing fluid flow through the fin. Further, the fins 18 spaced from the axis of the bend may also be crushed as a result of the stress from the force required to bend the headers 12. Air pressure drop increases as a result of the fin collapsing and the thermal performance of the tubes 16 adjacent the crushed fin also is reduced. Experimentally it was determined that bending the headers 12 resulted in approximately fifty percent of fins 18 exhibiting some crushing and therefore lessened thermal properties. The outer radius of the bend, shown in FIG. 2, stretches the fins 18 and stresses the tubes 16 adjacent the bend, which is also undesirable.

The related art core units and methods of forming the same are characterized by one or more inadequacy. Accordingly, it would be advantageous to provide a core unit and a method of forming the same that overcomes these inadequacies.

SUMMARY OF THE INVENTION AND ADVANTAGES

The subject invention provides a bent core unit for a heat exchanger. The core unit comprises a pair of headers spaced from one another each defining a fluid space for receiving a fluid therein and each defining a plurality of apertures. The core unit also comprises a first region and a second region spaced from the first region. The first region comprises a plurality of first tubes in a parallel relationship and extending between the headers in fluid communication with at least one of the apertures of each of the headers. The first region also comprises a first fin disposed between adjacent pairs of the first tubes for dissipating heat from the first tubes. The second region comprises a plurality of second tubes in a parallel relationship and extending between the headers in fluid communication with at least one aperture of each of the headers. The second region also comprises a second fin disposed between adjacent pairs of the second tubes for dissipating heat from the second tubes. A crushable center different than the first and second regions is disposed parallelly between the first and second regions for controllably crushing when the headers are bent.

One advantage of the subject invention is that the crushable center controls the crushing without sacrificing the adjacent first and second tubes and fins when the headers are bent. Since the crushable center serves as the site of the bend, the thermal performance of the core unit and the remaining uncrushed tubes and fins is maintained. Further, the core unit is orientated having the tubes vertically such that condensate drainage also does not pose a problem for the subject invention. The core unit is less likely to experience air pressure drops or condensate blockages as a result of having the tube vertically aligned.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, a bent core unit for a heat exchanger is shown generally at 20 in FIGS. 3A-4C. In conventional residential heat pump design, the heat exchanger functions as a condenser in cooling mode and an evaporator in heating mode. Frequently, the core unit 20 of the heat exchanger is bent to provide increased frontal area within a given cabinet size. Typically, the core unit 20 may be bent up to about 90°.

Figure 1:
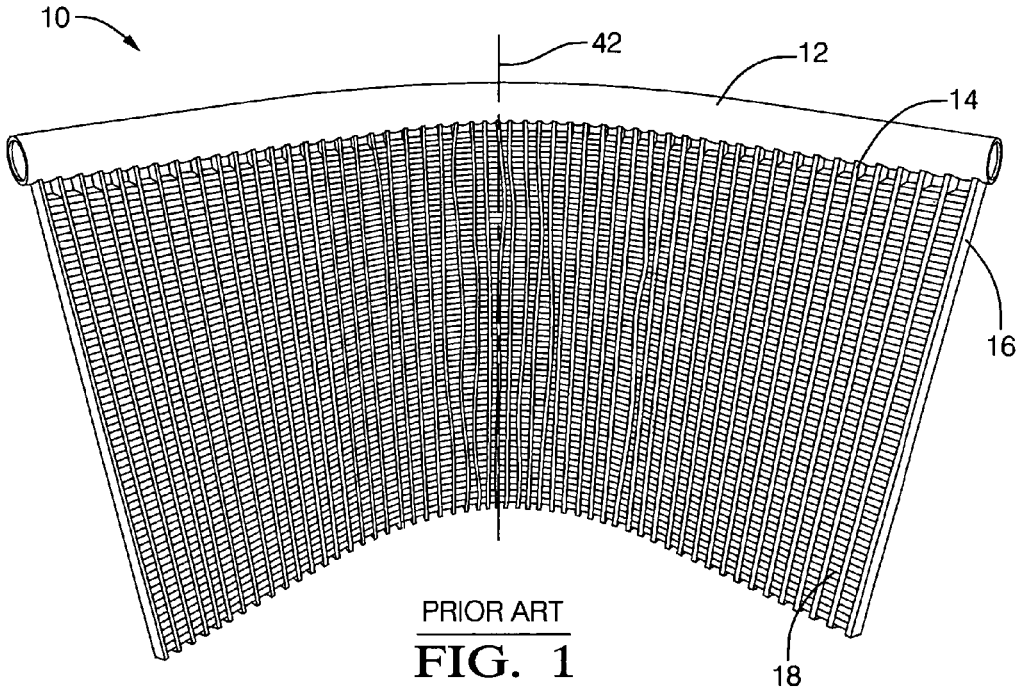
PRIOR ART FIG. 1
FIG. 1 is a partial perspective front view of a prior art core unit having headers that have been bent about an axis that is perpendicular to the headers resulting in fins that have been crushed.
Figure 2:
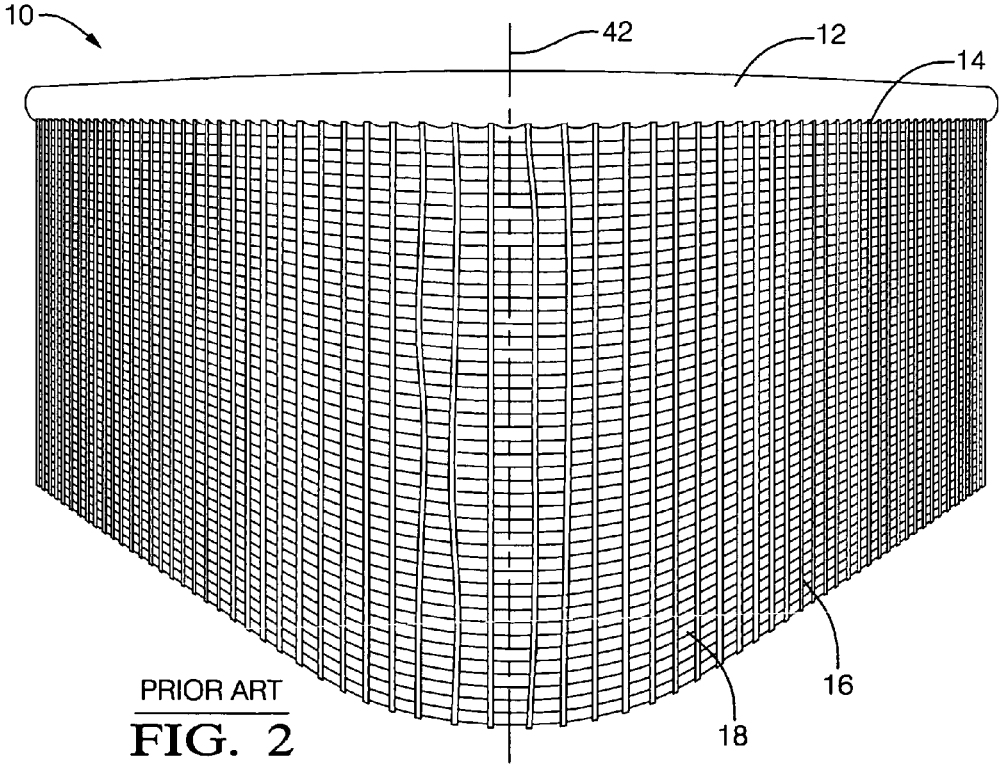
PRIOR ART FIG. 2
FIG. 2 is partial perspective rear view of a prior art core unit having headers that have been bent about an axis that is perpendicular to the headers resulting in fins and tubes that have been stressed.
Figure 3A:
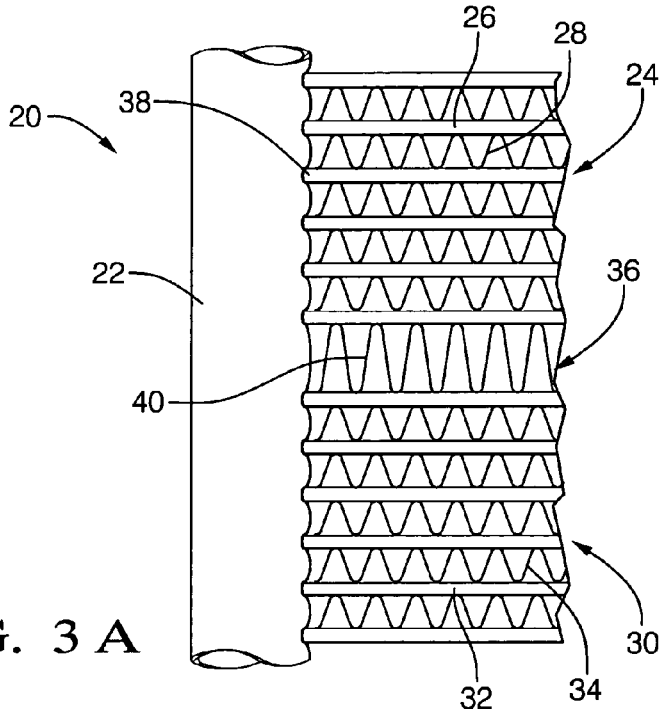
FIG. 3A is a partial close-up view of a core unit formed according to the subject invention having one embodiment of a crushable center disposed between first and second regions.
Figure 4A:
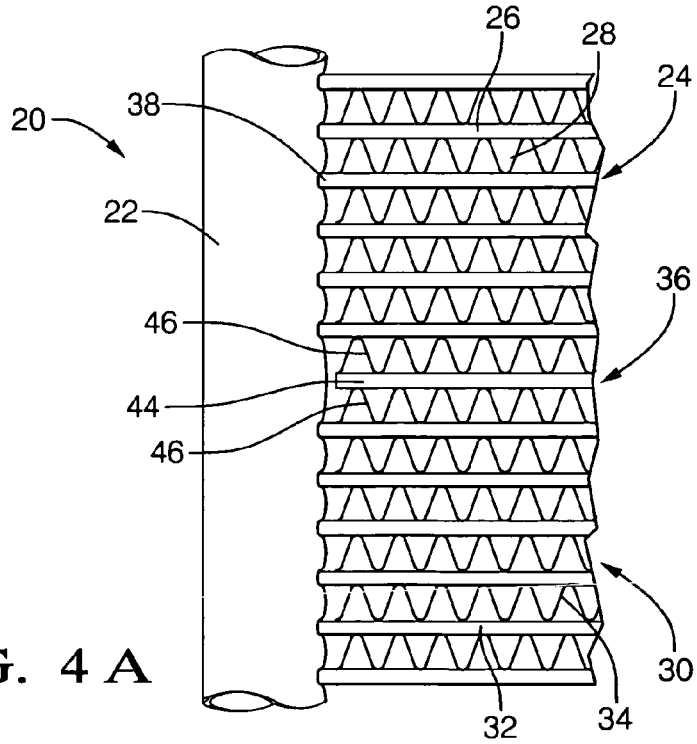
FIG. 4A is a partial close-up view of a core unit formed according to the subject invention having another embodiment of a crushable center disposed between first and second regions.

Referring to FIGS. 3A and 4A, the core unit 20 generally comprises a pair of headers 22, a first region 24 comprising first tubes 26 and first fins 28, and a second region 30 comprising second tubes 32 and second fins 34. A crushable center 36 different than the first and second regions 24, 30 is disposed parallelly between the first and second regions 24, 30 for controllably crushing when the headers 22 are bent. FIGS. 3A and 4A illustrate partial view of the core unit 20 and only one of the pair of headers 22 is shown. It is to be appreciated that the other header 22 is identical to the header 22 shown. The headers 22 are spaced from one another and each defines a fluid space for receiving a fluid therein. It is to be appreciated by those of ordinary skill in the art that different applications of the core unit 20, i.e., evaporator or condenser, may result in different types of fluids utilized for the different applications. Each of the headers 22 defines a plurality of apertures 38.

The first region 24 comprises the plurality of first tubes 26 in a parallel relationship. The first fins 28 are disposed between adjacent pairs of the first tubes 26. For each pair of first tubes 26, the first fin 28 is disposed therebetween as understood by those of ordinary skill in the art. The first tubes 26 extend between the headers 22 in fluid communication with at least one of the apertures 38 of each of the headers 22. In other words, the first tubes 26 are connected to the headers 22 via the apertures 38 for transferring fluid therebetween. The first tubes 26 may be standard circular tubes or flat tubes as are well known to those of ordinary skill in the art. Preferably, each of the plurality of first tubes 26 are substantially equally spaced from one another.

The first fin 28 dissipates heat from the first tubes 26 as a fluid, such as air, passes over the first fin 28. The first fin 28 may be standard plain fins, corrugated fins, louvered fins, or the like. The first fins 28 are bonded to the first tubes 26, preferably through a metallurgical bond, such as brazing. Other well known bonding techniques may also be used without departing from the subject invention.

The second region 30 comprises the plurality of second tubes 32 in a parallel relationship. The second fins 34 are disposed between adjacent pairs of the second tubes 32. For each pair of second tubes 32, the second fin 34 is disposed therebetween as understood by those of ordinary skill in the art. The second tubes 32 extend between the headers 22 in fluid communication with at least one aperture 38 of each of the headers 22. In other words, the second tubes 32 are connected to the headers 22 via the apertures 38 for transferring fluid therebetween. The second tubes 32 may be standard circular tubes or flat tubes as are well known to those of ordinary skill in the art. Preferably, each of the plurality of second tubes 32 are substantially equally spaced from one another.

The second fin 34 dissipates heat from the second tubes 32 as a fluid, such as air, passes over the second fin 34. The second fin 34 may be standard plain fins, corrugated fins, louvered fins, or the like. The second fins 34 are bonded to the second tubes 32, preferably through a metallurgical bond, such as brazing. Other well known bonding techniques may also be used without departing from the subject invention.

It is also contemplated that the first and second regions 24, 30 may be identical with a similar number and configuration of first and second tubes 26, 32, as well as first and second fins 28, 34. However, it is preferred that either the first or second regions 24, 30 will have more tubes than the other region and the first and second fins 28, 34 will be the same in each region 24, 30. For example, the first and second fins 28, 34 may both be louvered, i.e. have a plurality of louvers, with the same pattern of louvers.

The crushable center 36 controls the crushing when the headers 22 are bent as a result of being different than the first and second regions 24, 30. Preferably, in order to control the crushing, the crushable center 36 is weaker than the first and second regions 24, 30. By controlling the crushing, it is intended that the crushing of the air centers is localized to the crushable center 36. In this manner, little or no additional crushing of fins in the first and second regions 24, 30 occur. Various techniques have been discovered to isolate the crushable center 36 and weaken the crushable center 36 to control the crushing.

As one example, with reference to FIG. 3A, the crushable center 36 may comprise a third fin 40 having a height greater than a height of the first and second fins 28, 34. The third fin 40 may be a same or different type of fin than the first and second fins 28, 34. For instance, the third fin 40 may be a plain fin, whereas the first and second fins 28, 34 are louvered. Further, the third fin 40 may be formed from a material having a gauge less than the first or second fins 28, 34. Alternatively, if the third fin 40 is also louvered, the third fin 40 may have a louver pattern different than the pattern on the first and second fins 28, 34. It is to be appreciated by those of ordinary skill in the art that the louver pattern may increase the stability and/or strength of the fins, such that a different louver pattern may weaken the crushable center 36.

Figure 3B:
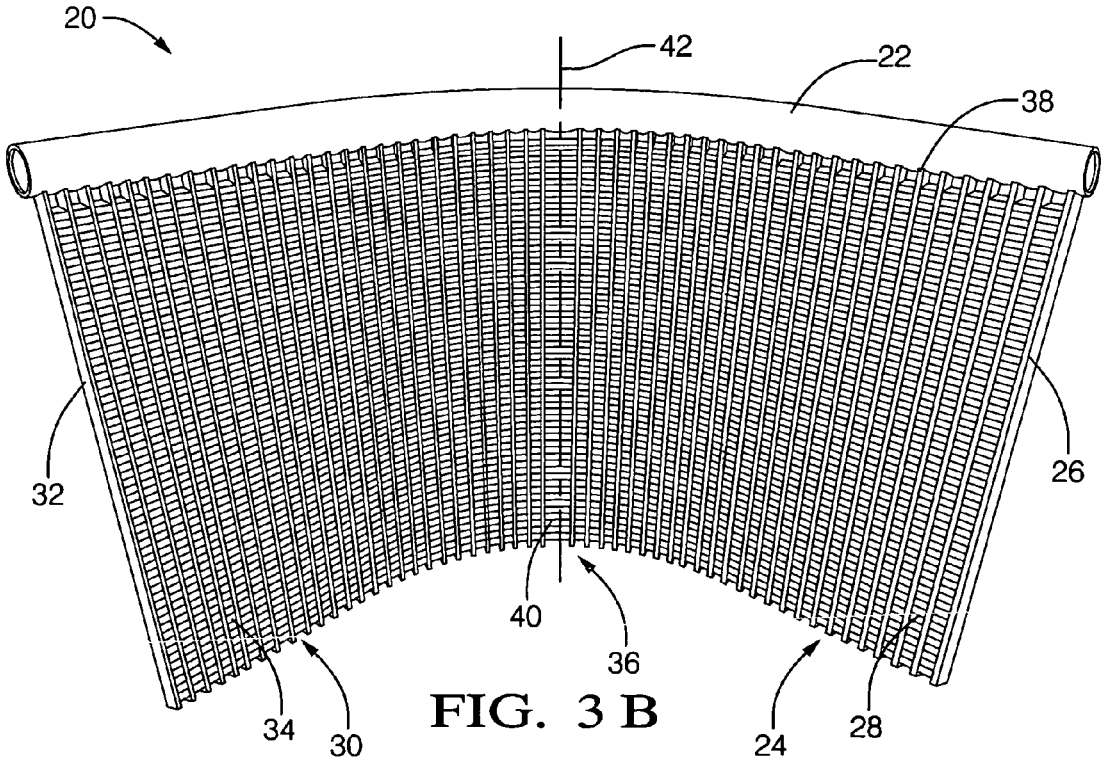
FIG. 3B is a partial perspective front view of the core unit shown in FIG. 3A bent about an axis that is perpendicular to the headers.
Figure 3C:
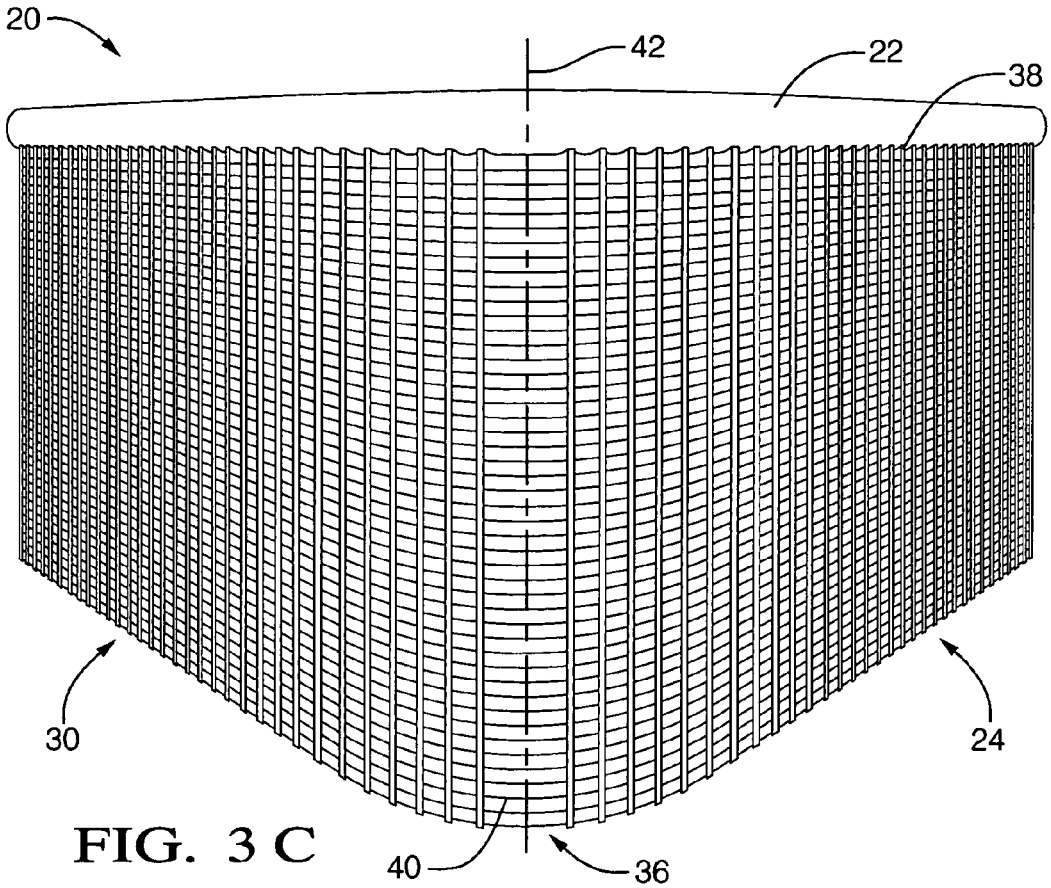
FIG. 3C is a partial perspective rear view of the core unit shown in FIG. 3A bent about an axis that is perpendicular to the headers.

FIGS. 3B and 3C illustrate the core unit 20 shown in FIG. 3A having been bent around an axis 42 that is perpendicular to the headers 22. FIG. 3B shows an inner radius of bend and FIG. 3C shows an outer radius of the bend. The crushable center 36 has localized the crushing and reduced the crushing of the fins in the first and second regions 24, 30.

Referring to FIG. 4A, as another example, the crushable center 36 may include a dummy tube 44 spaced between a pair of fourth fins 46. The dummy tube 44 is referred to as a "dummy" because the dummy tube 44 preferably has a length that is shorter than the first and second tubes 26, 32. In other words, the dummy tube 44 does not engage the headers 22 at either end and preferably at both ends. Further, the headers 22 may include a plug (not shown) disposed in the aperture 38 adjacent the dummy tube 44 such that dummy tube 44 could not connect to the headers 22. Preferably, the headers 22 will be formed without the aperture 38 adjacent the dummy tube 44 and the aperture 38 will not need to be plugged.

The fourth fin 46 may have a height that is the same, less, or greater than the first and second fins 28, 34. When the fourth fin 46 has the same height, the crushable center 36 is weakened as a result of the dummy tube 44 not engaging the headers 22. As the headers 22 are bent, the dummy tube 44 will serve as the location for the bend to occur. The crushable center 36 can again be further weakened if the fourth fins 46 are formed from a material having a gauge less than the first or second fins 28, 34 or if the fourth fins 46 have a height greater than a height of the first and second fins 28, 34.

Figure 4B:
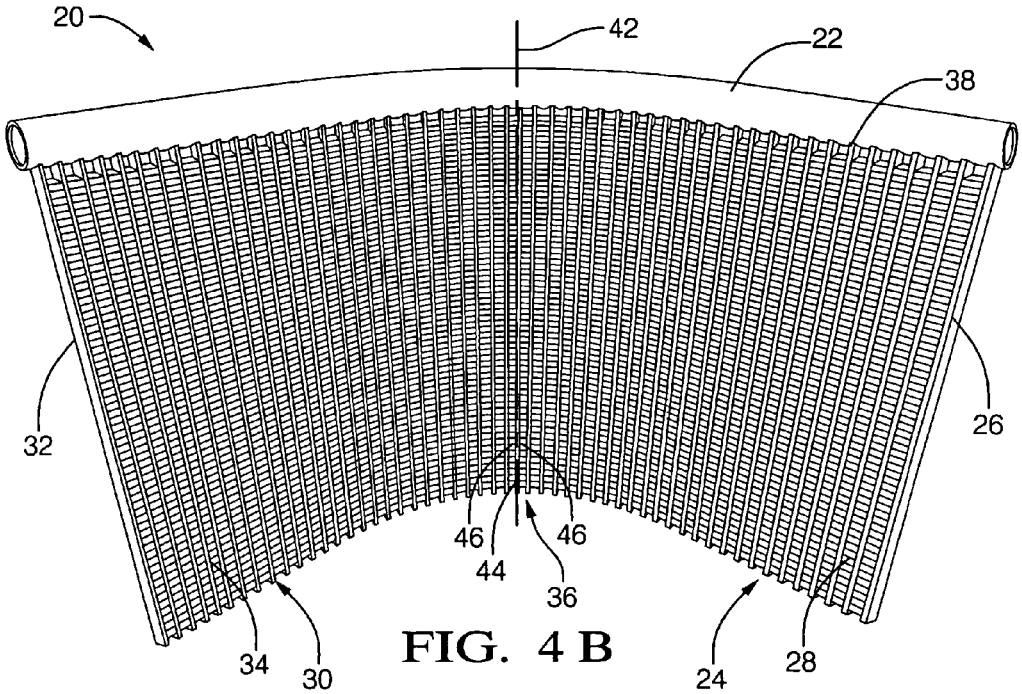
FIG. 4B is a partial perspective front view of the core unit shown in FIG. 4A bent about an axis that is perpendicular to the headers.
Figure 4C:
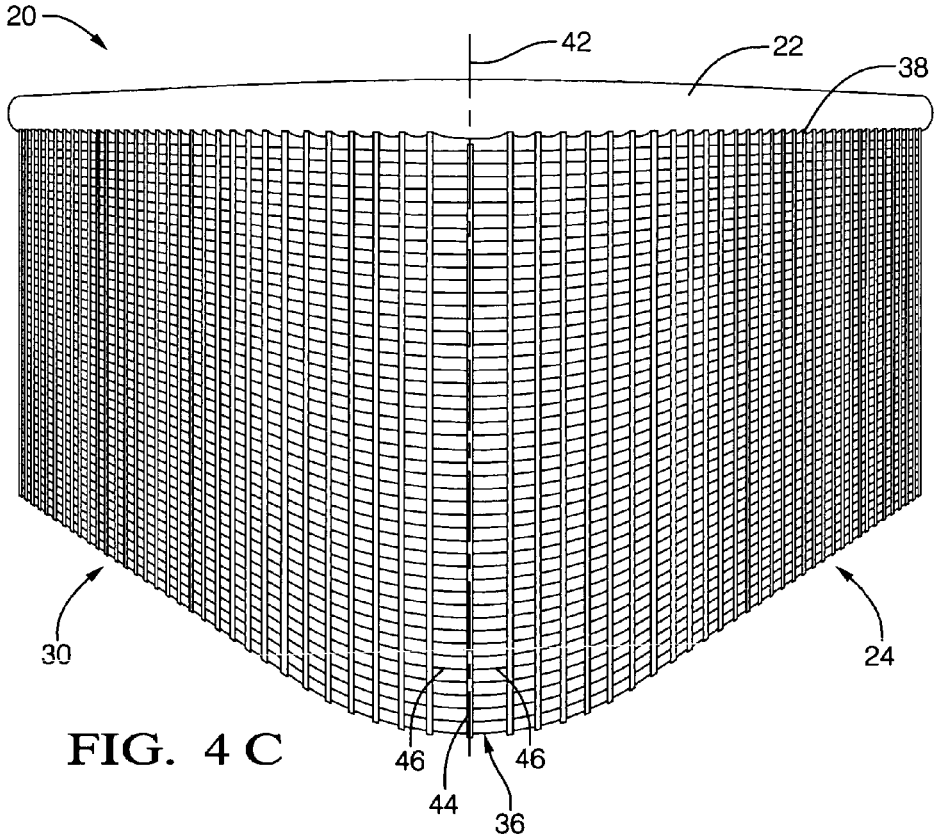
FIG. 4C is a partial perspective rear view of the core unit shown in FIG. 4A bent about an axis that is perpendicular to the headers.

FIGS. 4B and 4C illustrate the core unit 20 shown in FIG. 4A having been bent around an axis 42 that is perpendicular to the headers 22. FIG. 4B shows an inner radius of bend and FIG. 4C shows an outer radius of the bend. The crushable center 36 has localized the crushing and reduced the crushing of the fins in the first and second regions 24, 30.

Figure 5A:
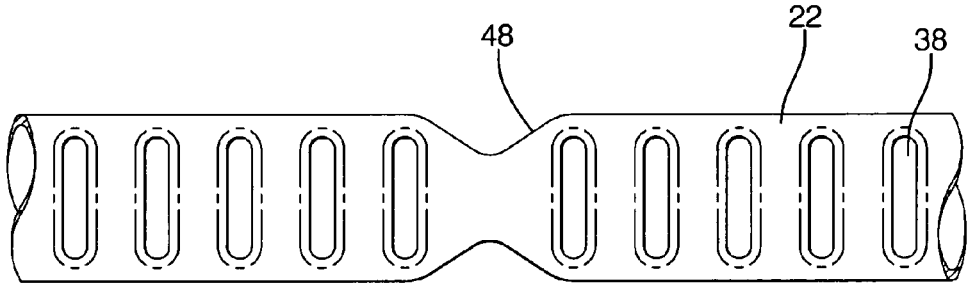
FIG. 5A is a partial front view of a header having indentations for facilitating bending of the header.
Figure 5B:
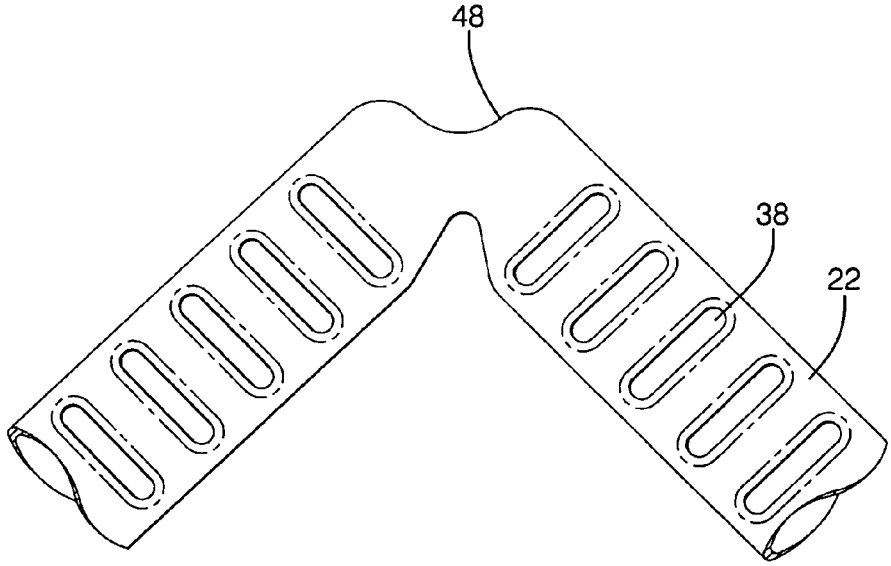
FIG. 5B is a partial front view the header shown in FIG. 5A having been bent.

Referring now to FIGS. 5A and 5B, the headers 22 may also include at least one indentation 48 for facilitating bending of the headers 22. The headers 22 may be bent at a single location or at a plurality of locations depending upon the desired application of the core unit 20. It is to be appreciated by those of ordinary skill in the art that either embodiment shown in FIGS. 3A and 4A may be used with headers 22 that are indented.

Figure 6A:
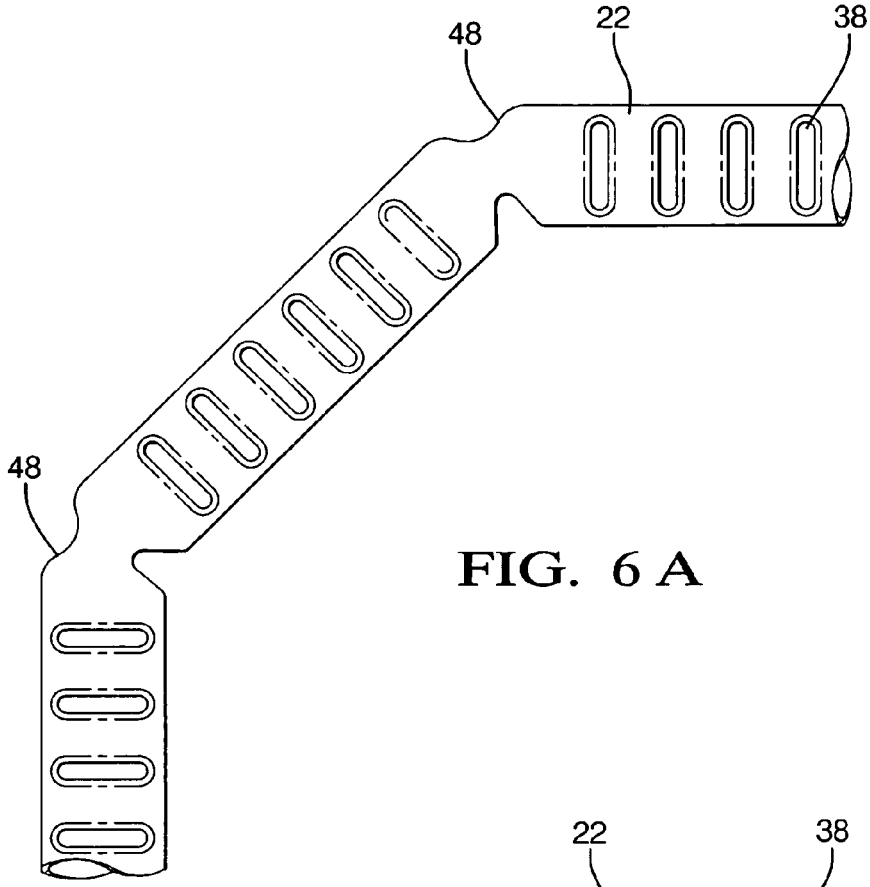
FIG. 6A is a partial front view of another embodiment of the header having a plurality of bends each of about 45 degrees.
Figure 6B:
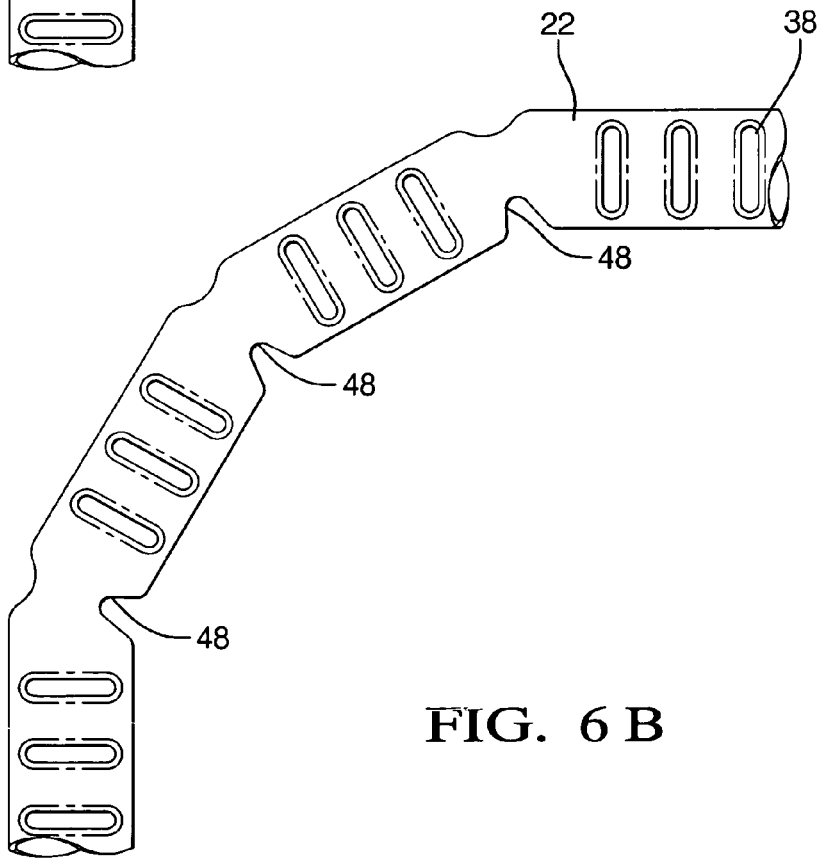
FIG. 6B is a partial front view of another embodiment of the header having a plurality of bends each of about 30 degrees.

The subject invention may also include the core unit 20 having a plurality of crushable centers 36, as shown in FIGS. 6A and 6*b*. The crushable centers 36 separate a plurality of adjacent regions 24, 30 for producing the core unit 20 with a plurality of bends. Multiple crushable centers 36 are advantageous to provide core units 20 that require sharper bends. FIG. 6A has two bends each at about 45 degrees and FIG. 6B has three bends each at about 30 degrees. It is to be appreciated by those of ordinary skill in the art that either embodiment shown in FIGS. 3A and 4A, or the combination thereof, may be used to accomplish these multiple bends.

One method of forming the core unit 20 comprises providing the pair of headers 22 spaced from one another with the apertures 38 so aligned. The first tubes 26 are disposed in parallel relationship between the headers 22 and in fluid communication with at least one of aperture 38 and the first fin 28 is brazed between adjacent pairs of the first tubes 26. Next, the second tubes 32 are disposed in parallel relationship between the headers 22 and in fluid communication with at least one aperture 38 and the second fin 34 is brazed between adjacent pairs of the second tubes 32. Finally, the crushable center 36 is disposed between the headers 22 and parallelly between the plurality of first and second tubes 26, 32.

The headers 22 are then bent at the desired locations. The crushable center 36 collapse as a result of being weaker to reduce crushing of the first and second fins 28, 34 adjacent the crushable center 36. As described above, the headers 22 may be bent at indentations 48 adjacent the crushable center 36 and may include the plurality of bends.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A bent core unit for a heat exchanger, said core unit comprising:

a pair of headers spaced from one another each defining a fluid space for receiving a fluid therein and each defining a plurality of apertures;

a first region comprising a plurality of first tubes in a parallel relationship and extending between said headers in fluid communication with at least one of said apertures of each of said headers for transferring fluid therebetween and comprising a first fin disposed between adjacent pairs of said first tubes for dissipating heat from said first tubes;

a second region comprising a plurality of second tubes in a parallel relationship and extending between said headers in fluid communication with at least one aperture of each of said headers for transferring fluid therebetween and comprising a second fin disposed between adjacent pairs of said second tubes for dissipating heat from said second tubes; and a crushable center different than said first and second regions and disposed parallelly between said first and second regions for controllably crushing when said headers are bent;

wherein said crushable center further comprises a third fin having a height greater than a height of said first and second fins; and wherein said third fin is further defined as formed from a material having a gauge less than said first or second fins.

* * * * *